US005497849A

United States Patent [19]

Duffy

[11] Patent Number: 5,497,849

[45] Date of Patent: Mar. 12, 1996

[54] LUFF GROOVE BRACKET AND METHOD

[76] Inventor: John C. Duffy, 7263 SW. 53rd Ct., Miami, Fla. 33143

[21] Appl. No.: 293,832

[22] Filed: Aug. 22, 1994

[51] Int. Cl.[6] ..... A63B 27/02

[52] U.S. Cl. ..... 182/136; 182/92; 248/246

[58] Field of Search ..... 182/133–136, 182/92; 248/244, 245, 246, 297.2, 297.5

[56] References Cited

U.S. PATENT DOCUMENTS

| | | | |
|---|---|---|---|
| 3,351,313 | 11/1967 | Guillon | 248/246 |
| 3,968,858 | 7/1976 | Vollan | 182/136 |
| 4,577,726 | 3/1986 | Wheeler | 182/196 |

FOREIGN PATENT DOCUMENTS

| | | | |
|---|---|---|---|
| 951322 | 3/1964 | United Kingdom | 248/245 |

*Primary Examiner*—Alvin C. Chin-Shue
*Attorney, Agent, or Firm*—Jack E. Dominik

[57] ABSTRACT

A shiftable bracket which has a body portion essentially tubular in length but significantly higher than it is wide and considerably longer than it is wide which has a central locking plate assembly is disclosed. The central locking plate assembly, in turn, has a locking flange at its remote end and a centrally oriented bore for receiving a lock plate assembly pin. A pair of lock plates are employed which are essentially the mirror image each of the other, and which have locking flanges at the remote ends for being positioned inside of a mast. Because they are in a pair, one can be inserted inside the mast slot, then the other one inserted, and thereafter the body of the shiftable bracket moved into position in alignment with the bores in the lock plate assembly, and thereafter the lock plate assembly pin pass through the two side plate portions of the body and pivotally engage the lock plate assemblies in place. Thereafter, the lower portion of the locking flanges will engage the interior portion of the mast and jam-fittingly lock the same in place against dislodgement downwardly in the absence of the body being put into an end parallel relationship with the flanges.

7 Claims, 3 Drawing Sheets

LUFF GROOVE BRACKET AND METHOD

FIELD OF THE INVENTION

The present invention relates to a Luff Groove Bracket and Method. The bracket finds unique utility for positioning in the mast of a sailboat which has a luff groove for receiving a sail interiorly of the mast. The method relates to securing the subject luff groove bracket to a mast and, for example, when using a pair create a walking step up the mast for use in those occasions where there is no hoisting equipment on the ship itself.

SUMMARY OF THE PRIOR ART

In going up and down the mast of a ship, for generations past, a bos'n's chair has been employed. Normally the bos'n's chair is a sling with the upper portion secured to a halyard. The halyard can be the jib halyard, the main halyard, or another line that is rigged to the top of the mast for normally pulling sails or other equipment to the top of the mast. Some devices have been developed for hoisting which secure to the end of a rope for locking auxiliary equipment in place.

What the prior art has failed to address, however, is the situation where the rigger or sailor may want to go up the mast and have the security and peace of mind of a second or third bracket to which he can secure a safety line, or the tools that he will need for the job or installation at the top of the mast. When considering a mast fifty feet in height, this involves the supplementation of a crane at considerable expense, or relying on the bos'n's chair which, in turn, relies upon the halyard which may have had extensive use and be in the incipient failure mode.

SUMMARY OF THE INVENTION

The present invention is directed to a shiftable bracket which has a body portion essentially tubular in length but significantly higher than it is wide and considerably longer than it is wide which has a central locking plate assembly. The central locking plate assembly, in turn, has a locking flange at its remote end and a centrally oriented bore for receiving a lock plate assembly pin. A pair of lock plates are employed which are essentially the mirror image each of the other, and which have locking flanges at the remote ends for being positioned inside of a mast. Because they are in a pair, one can be inserted inside the mast slot, then the other one inserted, and thereafter the body of the shiftable bracket moved into position in alignment with the bores in the lock plate assembly, and thereafter the lock plate assembly pin pass through the two side plate portions of the body and pivotally engage the lock plate assemblies in place. Thereafter, the lower portion of the locking flanges will engage the interior portion of the mast and jam-fittingly lock the same in place against dislodgement downwardly in the absence of the body being put into an end parallel relationship with the flanges.

The method of operation includes the steps of disassembling the unit, placing the lock plate body interiorly of the main body of the shiftable bracket, and thereafter pinning the same in place. In utilizing the shiftable bracket, however, it is possible to use two in unison. The lower one has an extended foot mount portion, and the upper one has an extended hand mount portion. This permits the rigger to secure the two on the mast, pass a loop around the foot, and "shinney" up the mast in a ratcheting operation. Alternatively, the shiftable bracket can be mounted at the upper portion of the mast when the rigger has gone up in a bos'n's chair and be utilized as an auxiliary safety line, or for the securement of a toolbox in position where the rigger can readily reach it to continue his operation.

While the invention is described in the practical marine environment for use on luff groove in a sail boat, other usages are contemplated, for example, exterior portions of a building may include a riser strip which is slotted for guiding scaffolding upwardly and downwardly. When the strip is provided with an undercut longitudinal groove, the subject bracket may be employed for comparable purposes in the subject strip groove.

In view of the foregoing it is a principal object of the present invention to provide a shiftable bracket and method for using the same on the mast of a boat having a slotted sail track to position various loads, including the human body, up and down the mast.

A related object of the present invention is to provide a shiftable bracket which will accommodate a wide variety of locking plates to accommodate the slot sizes in masts from boats that may measure twenty feet in height to seventy feet in height.

Yet another object of the present invention is to provide a shiftable bracket assembly which is inherently simple, easy to adjust and maintain, and relatively economical to manufacture therefore making it highly cost effective for the boat owner, a boat captain, or a rigger.

BRIEF DESCRIPTION OF THE ILLUSTRATIVE DRAWINGS

Further objects and advantages of the present invention will become apparent as the following description of an illustrative embodiment proceeds, taken in conjunction with the accompanying drawings, in which.

DESCRIPTION OF A PREFERRED EMBODIMENT

Figure 1:
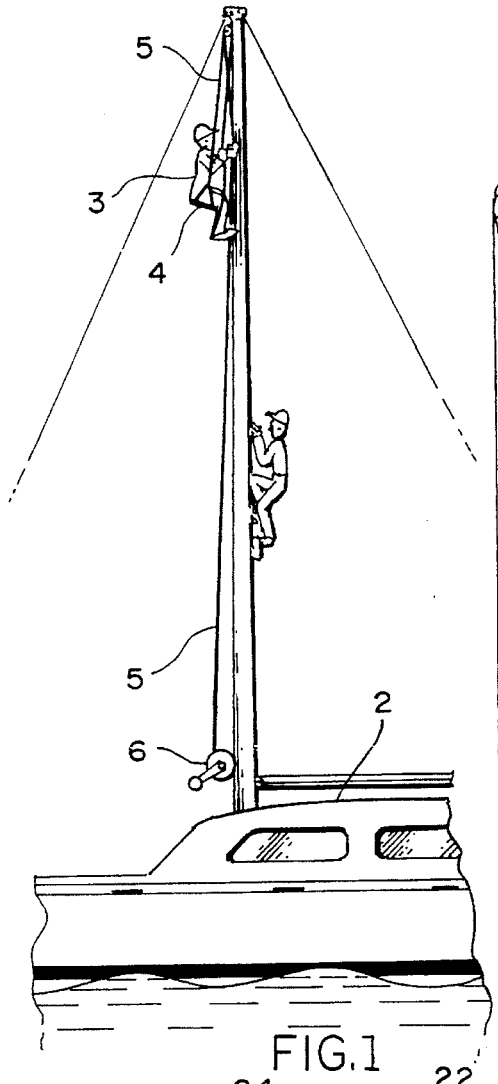
FIG. 1 is a view of a sailboat with a rigger near the top of the mast sitting in a bos'n's chair, and an exemplary rigger at the lower portion using two of the subject shiftable brackets in order to climb up the mast without the assistance of a halyard door bos'n's chair.
Figure 2:
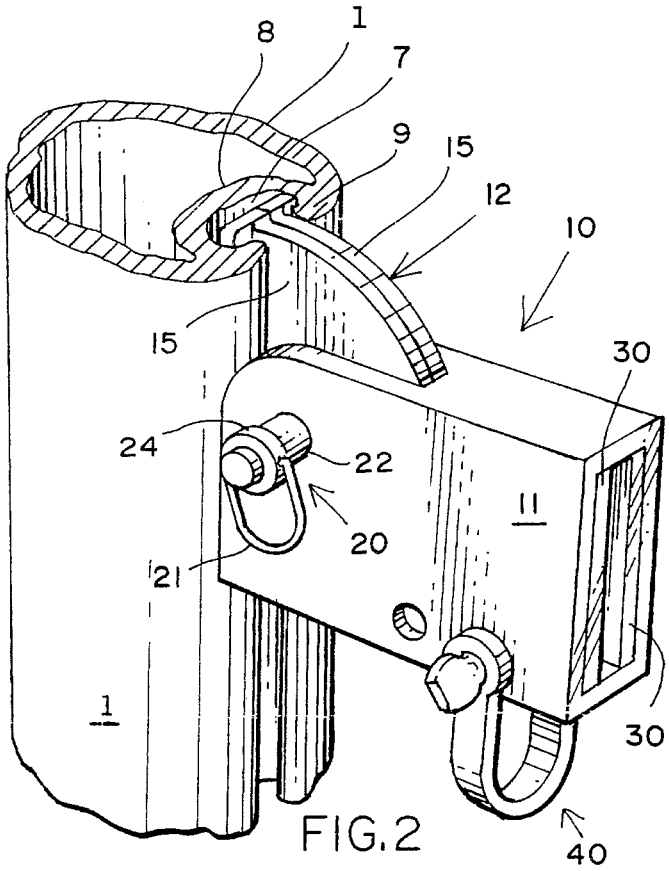
FIG. 2 is a perspective view, partially broken, showing the shiftable bracket interiorly of a typical mast luff groove.

The utilization of the shiftable bracket 10 as illustrated in FIG. 2 is best shown somewhat diagrammatically in FIG. 1. There it will be seen that mast 1 of the sail boat 2 extends upwardly and is supporting a rigger 3 who is sitting on a bos'n's chair 4 held suspended by means of a halyard 5 which is secured to a winch 6. When the halyard is missing, such as having been over-enthusiastically raised without a sail on it, one has to hope that there will be a second halyard. For example, if the main sail halyard has been raised the top, perhaps there is a jib halyard available. On the other hand, there may be cases where neither halyard is available and hence a bracket or brackets useful for climbing the mast 1 of the sail boat 2 is highly desirable. In this connection, the basic construction is shown in FIG. 2 where the illustrative mast 1 has a luff groove 7 which is formed by an inverted tube 8 having flanking rails 9 defining the opening for the luff of a sail.

Figure 5:
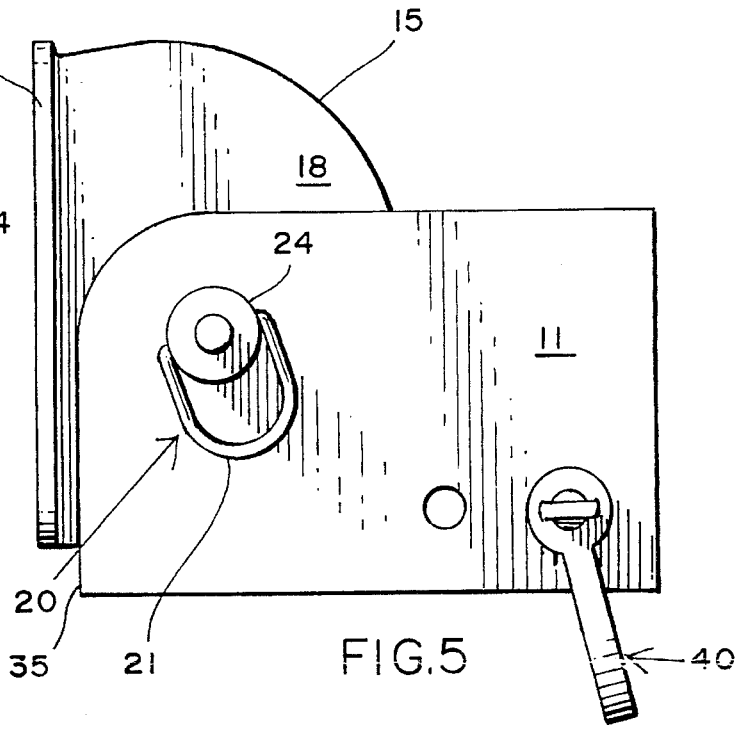
FIG. 5 is a plan view of the body portion.
Figure 6:
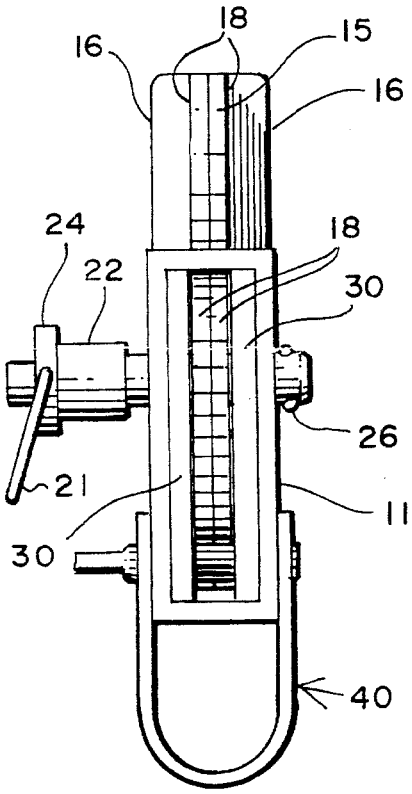
FIG. 6 is an end view of the body portion.
Figure 8:
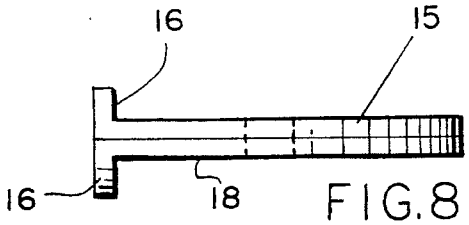
FIG. 8 is a top view of the shiftable bracket plates.

The adjustable bracket 10, as shown in FIG. 2, has a body 11 which is an elongate, rectangular, tubular affair. A locking plate assembly 12 pivotally is secured interiorly of the body 11. The separate lock plates 15 are shown in the left-hand portion of FIG. 3 where it will be seen that each lock plate 15 terminates in a lock plate flange 16 secured to a curvilinear lock plate body 18. The lock plate, in turn, as a pair, or separately, is secured interiorly of the body 11 by means of a lock plate pin 20. The lock plate pin 20 has a pin pull 21 which releases the release pins 26 so that shank 25 can be inserted into the body 11 to the end of the stop collar 22 and above the cap 24. The body pin holes 28 are on opposite sides of the tubular body 11. They permit the pin 20 to penetrate the pivot pinholes 36, 38 in the lock plate body 18. The pinholes 36, 38 in the lock plate body 18 may be varied in order to vary the gap between the lock plate flange 16 and the locking corner particularly as shown in FIG. 5. The gap can vary, therefore, as the rail 9 of the luff groove 7 may vary.

Since various sizes of lock plate assemblies 12 with their respective lock plates 15 are contemplated, spacers in the form of a pair of spacer blocks 30 fit interiorly of the tubular bracket body 11. The spacer blocks include the spacer block in holes and a relief arc 32. The relief arc 32 permits the swinging of the lock plates 12 and their respective flanges 16.

One of the purposes of the adjustable bracket 10 is to secure a tool box, or working members in place on a mast 12, the rigger is readying himself for use of the same. For example, a spreader could be carried upwardly or hoisted to the worker, and then the same secured to the bracket 10 by means of the shackle 40 as shown. The shackle 40 includes a stirrup portion 41 and a releasable pin 42 which is activated by a thumb grip 45 and secures the threads 46 into a threaded hole 44 in the stirrup 41. Body shackle pin holes 48 are received by a spacer shackle pin holes 48 prime to complete the securement of the shackle 40 in place on the adjustable bracket 10.

Figure 7:
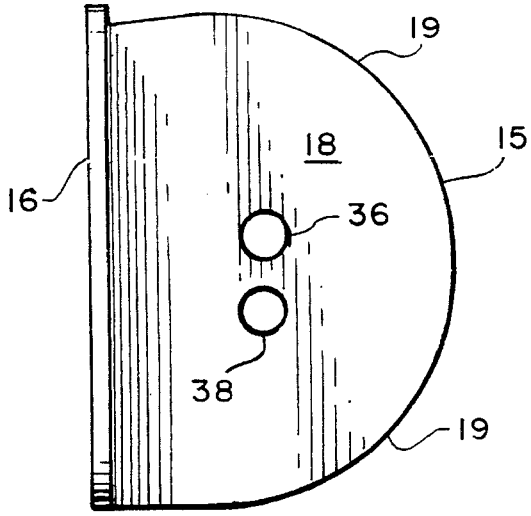
FIG. 7 is a plan view of the two shiftable bracket plates.

The parts as described above are shown in greater detail on FIGS. 4 through 8. Particularly as shown in FIGS. 5 and 7 are the curvilinear portions 19 of the lock plate body 18. The holes 36, 38 are designed so that a parallel relationship exists between the front portion of the body 11 and the adjacent flanges 16 specifically as shown in FIG. 5. It will be appreciated that when the body 11 is rotated, a jam acting effect takes place with the locking corner 35 of the body 11 and the rails 9 of the luff groove 7.

Figure 9:
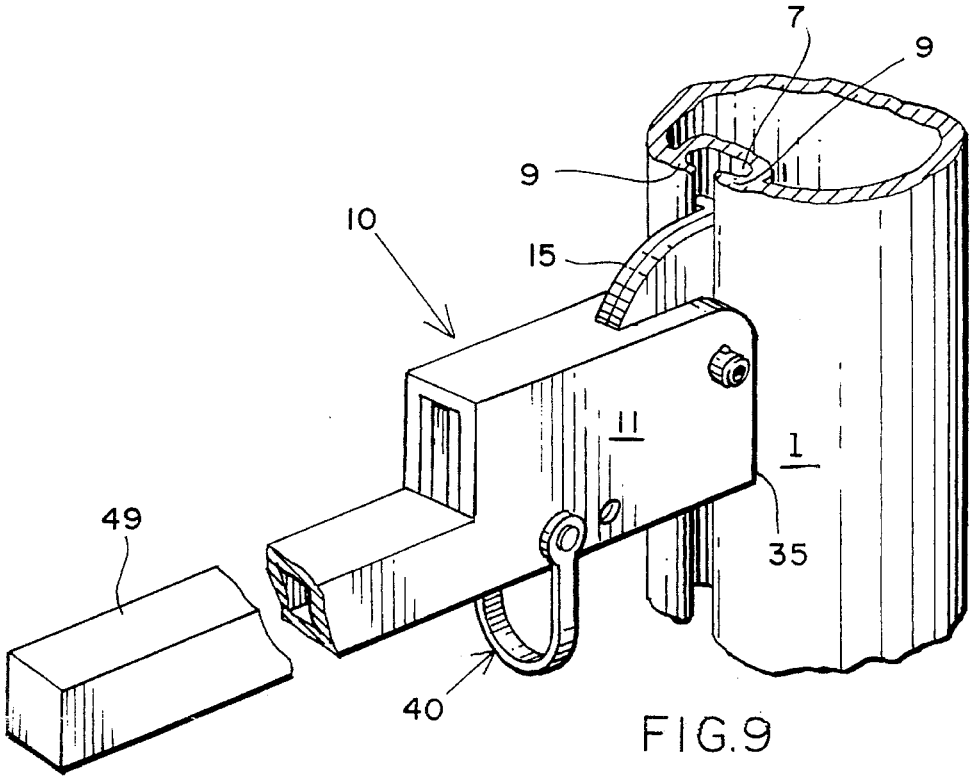
FIG. 9 shows one embodiment of a hand hold shelf bracket.
Figure 10:
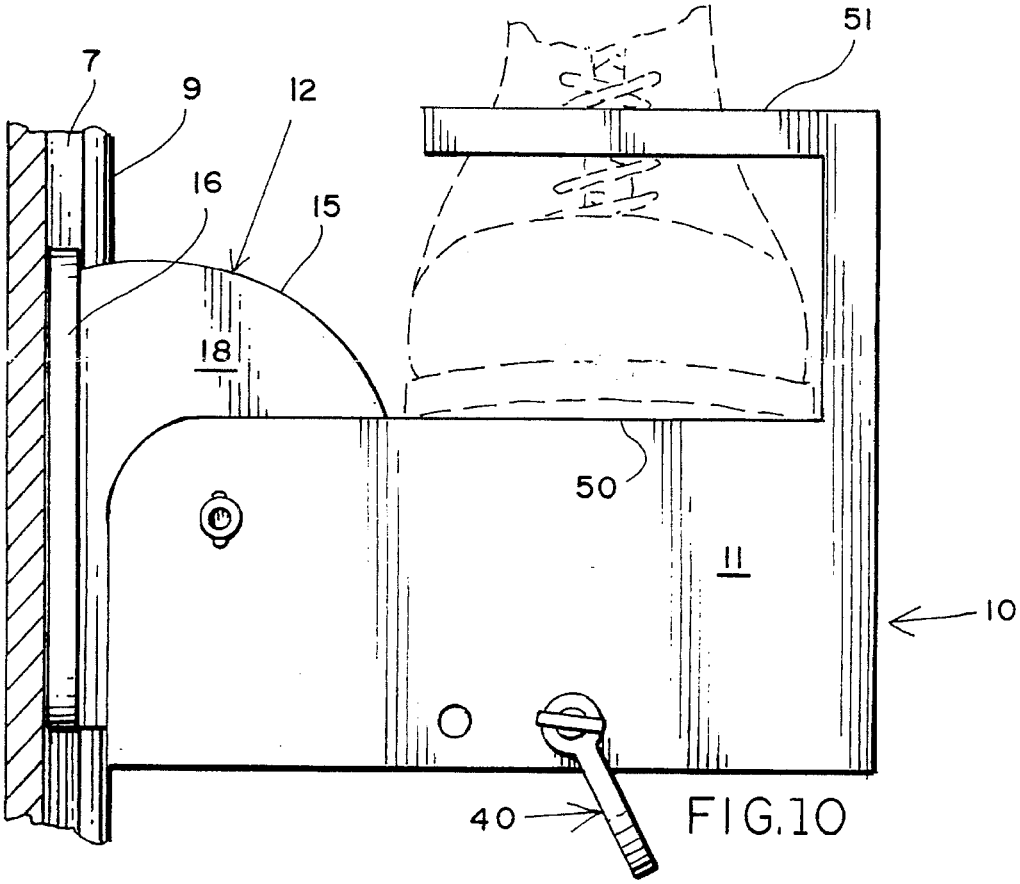
FIG. 10 shows an alternative embodiment extension serving as a footrest.

Two further embodiments of the bracket 10 are shown in FIGS. 9 and 10. In the embodiment shown in FIG. 9, an extended hand grip 49 is developed as an extension from the lower portion of the body 11 of the adjustable bracket 10. Its usage is illustrated diagrammatically in FIG. 1 where the rigger is moving upwardly with the hand grip portion in his hand. Yet another embodiment of the adjustable bracket 10 is shown in FIG. 10 where the shoe of the rigger is inserted underneath of the foot bracket 51 which permits the rigger to raise his foot, release the grip of the locking corner 35 against the luff groove rail 9, disengaging the locking corner 35 therefrom. Then the adjustable bracket for the foot is raised to again be pressed downwardly and lockingly engage the luff groove rail 9 at a new position. In each instance, as shown in FIGS. 9 and 10, provision is made for the utilization of a shackle 40 so that in addition to serving as either a hand grip, or a foot grip, the adjustable bracket can carry a load.

Figure 3:
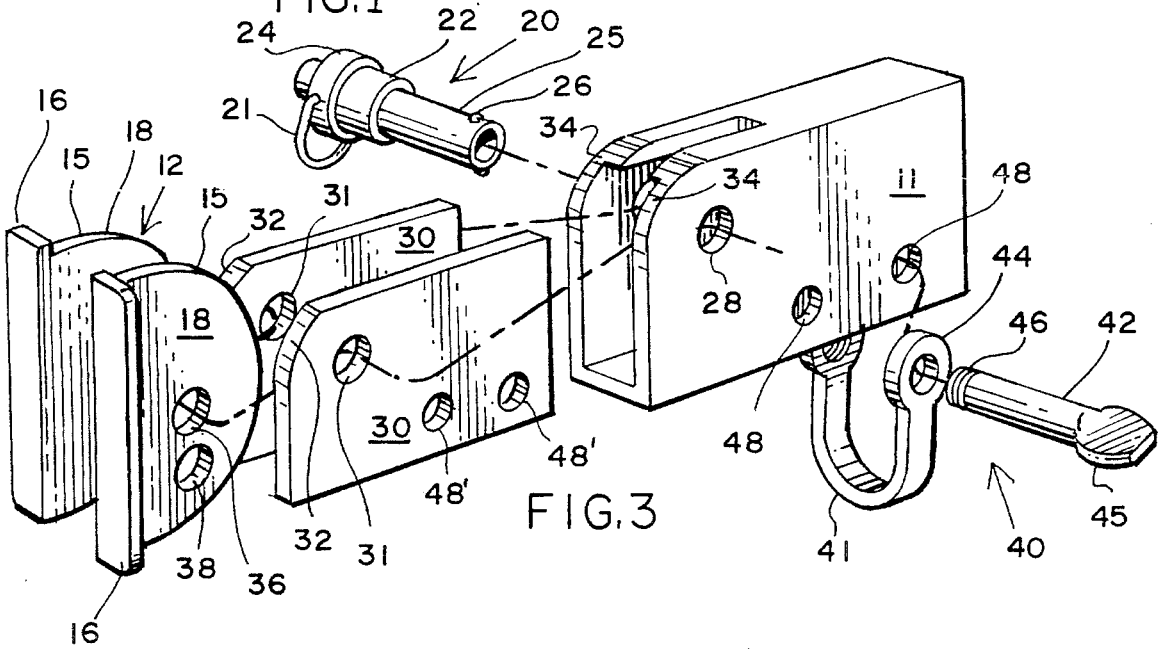
FIG. 3 is an exploded perspective view of the various parts of the luff groove bracket.
Figure 4:
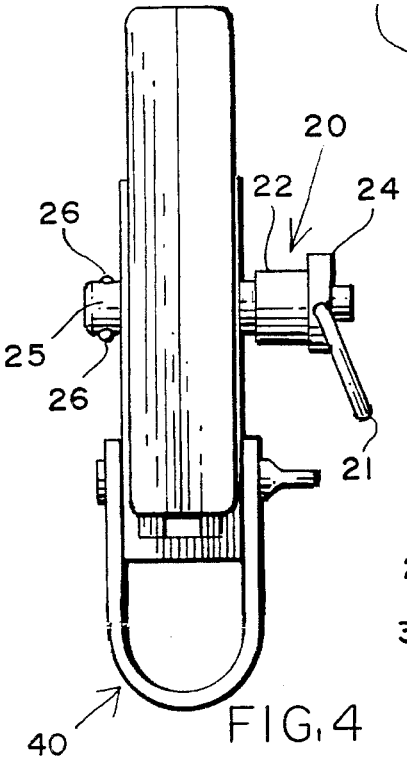
FIG. 4 is a front elevation of the subject luff groove bracket showing its interior portions in phantom lines.

The method of the invention essentially requires taking the adjustable bracket and removing the lock plate pin 20 by pulling on the handle 21 which releases the release pins 26 and the entire pin is removed. Thereafter the lock plate assembly 12 is separated and the two separate lock plates are inserted in the luff group 7 of the mast 1. Once they are adjusted in a parallel form as showing FIG. 2, the lock plate bodies 18 are then resecured in position by inserting the lock plate pin 20 to the configuration as shown in FIG. 2 from the arm secured configuration as shown in FIG. 3. Once this activity has taken place, then either the lock plate 10 as shown in FIGS. 2 and 3, or the hand grip assembly as shown is FIG. 9 or the foot grip assembly as shown in FIG. 10 are sequentially positioned on the mast. Going up and down the mast is straightforward once the remote hand grip as shown in FIG. 9 is positioned above the foot grip as shown in FIG. 10.

As mentioned earlier in the description, the subject adjustable bracket 10 is shown in the environment of a sail boat mast 1. The brackets would have similar usage in scaling most any structure that is supplied with a vertical support member something like the luff groove 7 illustrated. For example, for window washing, or otherwise servicing the exterior of a building, an extrusion containing a comparable grooves, when mounted on the structure, will serve to permit service personnel in going up and down the unit.

In addition, as shown in fantom lines in FIG. 9, a shelf can be positioned atop the embodiment having the extending hand hold. This permits the installation of temporary and shiftable shelving which can be used for filing, storage, and a whole host of other activities. A vertical structure which includes a duplicate of a portion of a mast and the luff groove is first positioned in place. Once it is in place, a plurality of the brackets 10 containing the extended hand hold or shelf bracket 49 can adjustably support a whole host of shelves. In addition, the center distance from the pivot pin board in the latch plates can be spaced further from the curvilinear edge in order to accommodate a thicker luff rail type element.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. A shiftable bracket for securing in a groove in an elongate member comprising, in combination, a tubular bracket body, a lock plate assembly having two lock plates motion bodies, and a lock flange along one end of each body motion, said lock plates having a curvilinear portion, a rearwardly extending slot in an upper portion of the tubular body for receiving the body portions of the lock plates adjacent to the curvilinear end, a through bore passing through the tubular body, a through bore centrally positioned in each lock plate, and means for pivotally securing the lock plates interiorly of the tubular body.

2. In the shiftable bracket of claim 1 above, said tubular body having opposed parallel sides.

3. In the shiftable bracket assembly of claim 1, said through bore of each lock plate being oriented to provide a gap between the locking flange and a forward portion of the tubular body slightly larger than the groove intended to be grasped.

4. In the shiftable bracket of claim 1, said lock plate assembly having mirror image lock plate bodies and flanges, and each of said lock plates having said curvilinear portion from adjacent an upper portion of a flange to the lower portion of said flange.

5. A shiftable bracket for securing in a groove in an elongate member comprising, in combination, a bracket body having opposed parallel sides secured by edges which define an interior portion, a lock plate assembly having mirror image lock plates each having a lock plate body, and a lock flange along one end of the body, said lock plate having a curvilinear upper portion extending from upper and lower ends of each flange, a rearwardly extending slot in the upper wall of the bracket body for receiving the lock plate body portions adjacent the curvilinear, a through bore passing through the tubular body, a through bore centrally positioned in each lock plate, and means for pivotally securing the mirror image lock plates interiorly of the tubular body, whereby upon positioning the two lock plates interiorly of the groove, assembling the shiftable bracket, the same can be moved up and down the groove when the lock flanges are parallel with the end of the bracket body, and yet when a load is applied to an outward portion of the bracket body, the load will cause the lock flanges to jam-fittingly engage and press against the interior portion of the groove, securing the shiftable bracket in a removably secured fashion and self-energizingly lock fashion up and down the entire interior portion of the groove.

6. A method for securing a shiftable bracket to a mast luff groove of a sailboat comprising:

said bracket having a tubular body portion having two lock plate motion bodies with curvilinear portions and, a lock plate assembly lock flanges at one end thereat, the curvilinear portions being pivotally secured interiorly to the tubular body which can limit the rotation of the lock plate assembly comprising the steps of:

separating the lock plates and having the lock plates sequentially positioned interiorly of the mast luff groove, paralleling the lock plates to where the flanges form a coplanar orientation, pivotally securing the lock plate assembly interiorly of the tubular body, and sliding the shiftable bracket up and down the mast luff groove until a preselected position is reached, and thereafter loading the shiftable bracket so that the lock plate assembly will self-energizingly engage the mast on the interior of the groove.

7. In the method of claim 6 above, positioning two such shiftable brackets at spaced locations on the mast, providing one with an extending handle, providing the other with an extending foot portion, and securing the foot portion in place with a strap which permits the user to ratchet himself up and down the mast holding one such shiftable bracket in his hand and securing the other to his foot.

* * * * *